United States Patent [19]

Ballentine et al.

[11] Patent Number: 4,747,471

[45] Date of Patent: May 31, 1988

[54] COMPRESSOR LUBRICATION SYSTEM

[75] Inventors: Paul H. Ballentine, Cazenovia; Max P. Waser, Syracuse, both of N.Y.

[73] Assignee: Carrier Corporation, Syracuse, N.Y.

[21] Appl. No.: 881,429

[22] Filed: Jul. 2, 1986

[51] Int. Cl.[4] ..... F04B 39/02

[52] U.S. Cl. ..... 184/6.18; 184/6.23; 415/119; 417/902

[58] Field of Search ..... 184/6.16, 6.18, 6.23; 417/368, 902; 415/88, 119

[56] References Cited

U.S. PATENT DOCUMENTS

| | | | |
|---|---|---|---|
| 3,049,285 | 8/1962 | Doeg | 417/902 X |
| 3,147,914 | 9/1964 | Hatten et al. | 417/902 X |
| 3,480,205 | 11/1969 | Hatten | 417/902 X |
| 4,565,503 | 1/1986 | Wise | 417/902 X |

FOREIGN PATENT DOCUMENTS

| | | | |
|---|---|---|---|
| 237182 | 11/1985 | Japan | 417/366 |

*Primary Examiner*—Leonard E. Smith
*Attorney, Agent, or Firm*—Robert H. Kelly

[57] ABSTRACT

The stratification of the oil-foam mixture in the shell of a compressor is avoided by enhancing the recirculation vortex in the shell. The enhancement of the recirculation or secondary vortex is achieved by providing a baffle plate at the bottom of the shell which effectively mixes the oil and foam by providing a region near the bottom of the shell in which the fluid is not rotating in a horizontal plane. The non-rotating oil is drawn towards the center of the shell by the centrifugal pressure gradient, thus displacing the foam from the center region of the shell.

4 Claims, 2 Drawing Sheets

COMPRESSOR LUBRICATION SYSTEM

BACKGROUND OF THE INVENTION

In hermetic refrigerant compressor units, oil is drawn from a sump by a lubrication pump to provide lubrication to the compressor. It is well known that if the oil in the sump is caused to froth or foam, that there is a reduction in the sound of the unit. Accordingly, an impeller, generally in the form of paddles, has been placed on the lubricant pickup tube for foam generation, thus reducing noise of the unit. However, in every rotating body of fluid there is a centrifugal pressure gradient which balances the centripetal acceleration of the fluid. If the fluid has two components, one less dense than the other, the less dense fluid will be forced towards the center of rotation while the more dense fluid will be forced towards the outside. For example, when the oil of a compressor is caused to foam by an impeller, any refrigerant bubbles that are trapped in the oil tend to accumulate at the center of the impeller. Thus, the presence of paddles has reduced the amount of oil pumped and, on occasion, there may be a compressor failure due to inadequate lubrication. The apparent cause of inadequate lubrication is the accumulation of refrigerant vapor near the pump inlet which inhibits the flow of oil into the end of the pickup tube so that oil is no longer supplied to the bearings.

SUMMARY OF THE INVENTION

In addition to its primary rotation, a primary vortex in a horizontal plane, a rotating fluid enclosed in a non-rotating housing has a weak secondary rotation, or secondary vortex in a vertical plane, which tends to mix the fluid near the center with the fluid near the outside walls. Fluid particles near the bottom of the enclosure will not be rotating due to boundary layer effects and so will be drawn towards the center by the centrifugal pressure gradient, thus displacing other particles upwards and outwards. Thus, in an elevational plane through the center of an impeller in a vessel, the fluid in the right hand portion of the vessel rotates clockwise while the fluid in the left hand plane rotates counterclockwise. This secondary vortex can be used to effectively mix the foam and oil in a compressor and thereby increase the amount of oil flowing towards the center of the vessel by providing an extended region near the bottom of the shell that inhibits the fluid from rotating.

This invention is directed to a baffle which enhances the secondary vortex by providing a region whereby the non-rotating oil will be drawn radially towards the center of the shell by a centrifugal pressure gradient, thus displacing the foam from the center region of the impeller.

It is an object of the present invention to increase the flow of oil to the bearings of a compressor while maintaining the presence of foam in the shell.

It is another object of the present invention to prevent stratification of the oil-foam mixture in the shell of a compressor.

It is a further object of the present invention to enhance the recirculation vortex that naturally exists in the shell of a compressor to increase the flow of oil to the bearings of the compressor.

It is still a further object of the present invention to provide a baffle arrangement for the shell of a compressor which is economical to manufacture, simple in construction, and effectively mixes the foam and oil in a compressor.

The various features of novelty which characterize the invention are pointed out with particularity in the claims annexed to and forming part of this specification. For a better understanding of the invention, its operating advantages and specific objects attained by its use, reference should be had to the accompanying drawings and descriptive matter in which there is illustrated and described a preferred embodiment of the invention.

BRIEF DESCRIPTION OF THE DRAWINGS

In the accompanying drawings, forming a part of the specification, and in which reference numerals shown in the drawings designating like or corresponding parts throughout the same.

DESCRIPTION OF THE PREFERRED EMBODIMENT

Figure 1:
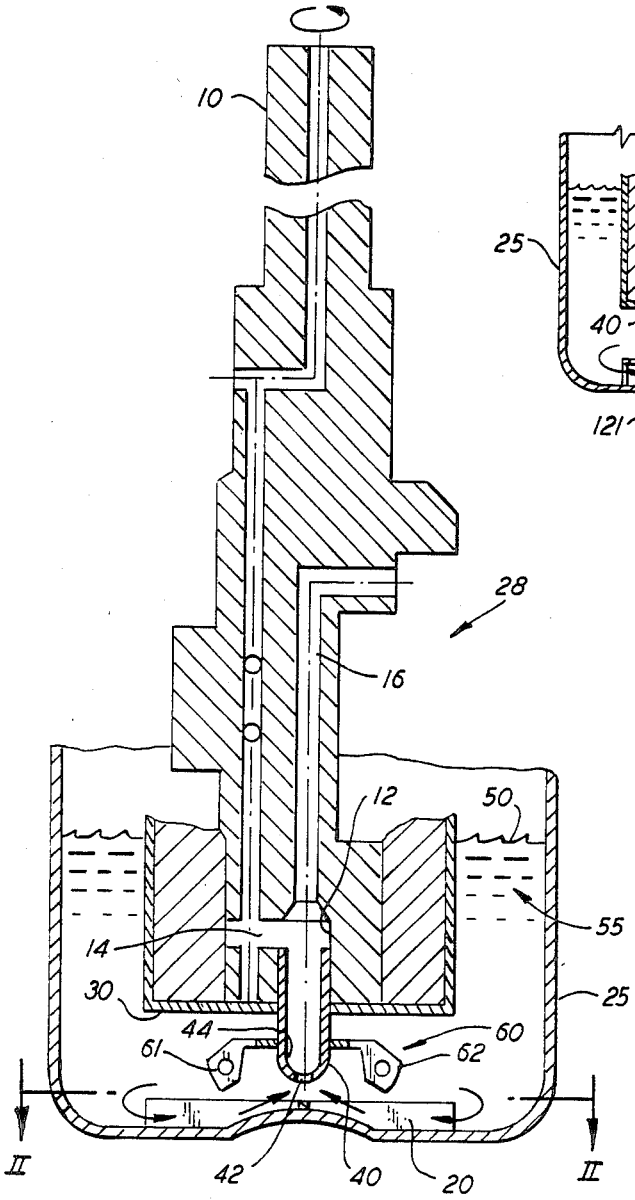
FIG. 1 is a sectional view of a schematic representation of the lubrication system of a vertical shaft hermetic refrigerant compressor with a single-stage centrifugal oil pump and a baffle of the present invention.
Figure 2:
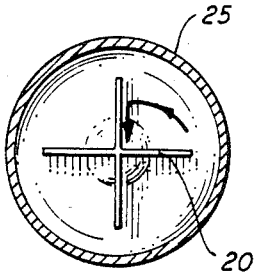
FIG. 2 is a plan view of the baffle shown in FIG. 1, along the lines II—II of FIG. 1.

In FIG. 1 the numeral 10 generally designates a crankshaft of refrigerant compressor 28 which is vertically supported by thrust plate 30 and is rotatably driven about an axis at an angular velocity, shown by the upper arrow, by a motor (not illustrated). Pickup tube 40 is force fit in bore 12 of crankshaft 10 coaxial with the axis of rotation of the crankshaft 10 and extends through thrust plate 30 beneath the surface 50 of the oil sump 55. Pickup tube 40 has an inlet 42 communicating with bore 44 for delivering oil from the sump 55 to bore 12 where centrifugal forces tend to direct the oil radially outward into radial bore 14 for delivery to the parts requiring lubrication while the separated entrained refrigerant gas passes through axial bore 16 to vent. An impeller 60 having paddles 61 and 62 is force fit on pickup tube 40 and is beneath the quiescent surface 50 of the sump 55. With the impeller 60 placed upon the pickup tube 40 above the baffle means 20 as illustrated in FIG. 1, the rotation of the crankshaft 10, pickup tube 40, and impeller 60 results in the rotation of the bulk of the oil-foam mixture. Baffle means 20 secured to bottom of the shell 25 of the compressor 28 in the oil sump 55 provides a region near the bottom of the sump in which the oil is not rotating, but is drawn towards the center of the oil sump 55 by the centrifugal pressure gradient, thus displacing the oil-foam mixture from the center of the sump. Thus the stratification of the oil-foam mixture in the oil sump 55 which prevents sufficient lubricating oil from being supplied to the bearings is overcome by enhancing the secondary vortex in the shell, and increasing the flow of oil to the bearings while maintaining the presence of foam, to improve sound attenuation, in the shell 25 of the compressor. As illustrated in FIG. 2, the cruciform shape of the baffle means 20 changes the radial primary vortex into axial momentum, as shown by the arrow, and therefore oil is drawn into the center of the casing displacing the foam from the pickup tube 40 at the center of the oil sump 55.

Figure 3:
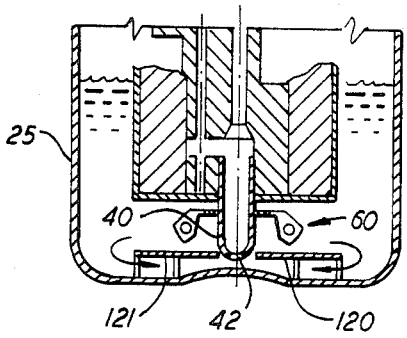
FIG. 3 is a partial sectional view of the hermetic refrigerant compressor of FIG. 1 showing an alternate embodiment of the baffle.

If the baffle means 20 of FIGS. 1 and 2 is modified to baffle means 120 of FIG. 3, by having a generally flat plate 121 spaced from the bottom of the shell 25, oil below the flat plate 121 which is not rotating will be drawn towards the center of the shell due to a pressure gradient as shown by the arrows and into the inlet 42 of the pickup tube 40.

Figure 4:
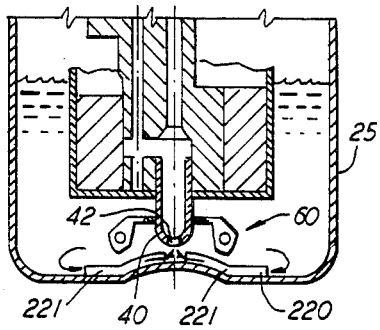
FIG. 4 is a partial sectional view of the hermetic refrigerant compressor of FIG. 1 showing another alternate embodiment of the baffle.

If the baffle means 20 of FIGS. 1 and 2 is modified to baffle means 220 of FIG. 4, by having a plurality of tubes 221 secured near the bottom of the shell 25, oil will be drawn through the tubes 22 as shown by the arrows and into the center of the shell and into the inlet 42 of the pickup tube 40 since the only force exerted on the fluid is a force due to a pressure gradient between the center and the wall of the shell.

Figure 5:
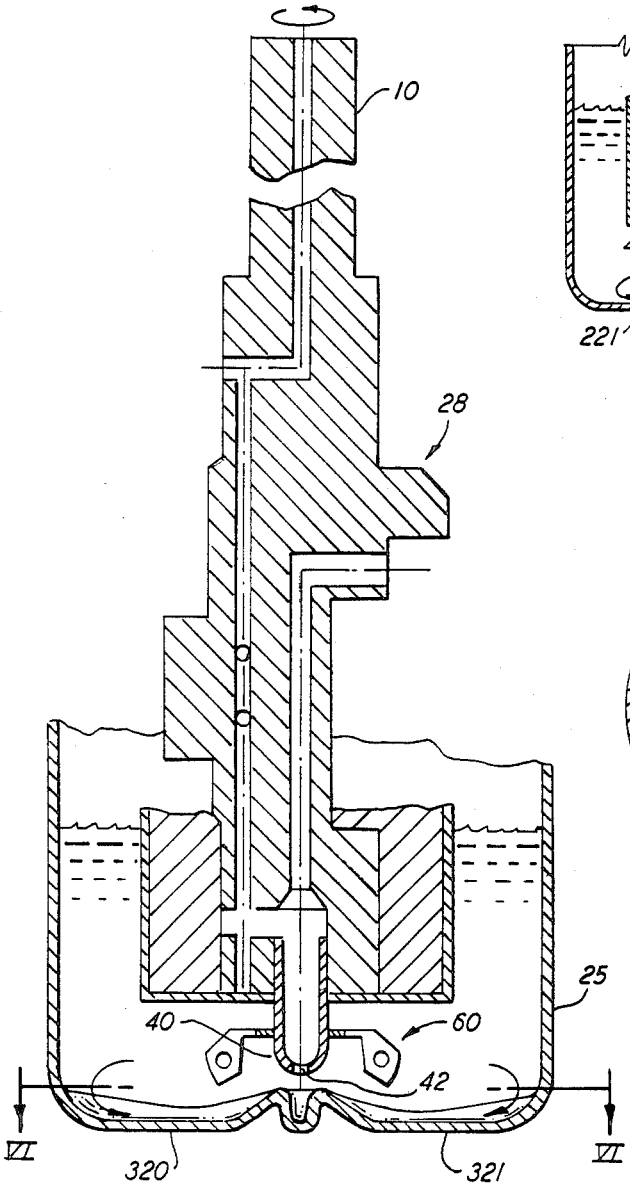
FIG. 5 is a partial sectional view of the hermetic refrigerant compressor of FIG. 1 showing still another alternate embodiment of the baffle.
Figure 6:
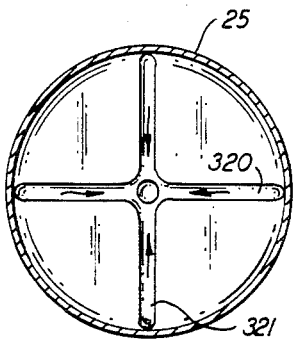
FIG. 6 is a plan view of the baffle shown in FIG. 5, along the lines of VI—VI of FIG. 5.

If the baffle means 20 of FIGS. 1 and 2 is modified to baffle means 320 of FIGS. 5 and 6, by having a plurality of channels 321 formed in the bottom of shell 25, oil will be drawn in the channels 321, as shown by the arrows, and into the center of the shell and into the inlet 42 of the pickup tube 40 since there is no angular force on the fluid, but only a force due to the pressure difference of the fluid.

From the foregoing it will be noted that the non-rotating oil near the bottom of the shell will be drawn towards the center by the centrifugal pressure gradient, thus displacing the foam from the center of the shell. This mixing of the foam and oil in the compressor by the secondary vortex also improves the sound attenuation in the oil-foam mixture by dispersing the foam more evenly throughout the shell.

Although this invention has been described with reference to the particular embodiments disclosed herein, it is not confined to the details set forth herein, and this application is intended to cover any modifications or changes that will occur to one skilled in the art, and the present invention is to be limited only by the scope of the appended claims.

What is claimed is:

1. An oil lubrication and noise suppression system for a refrigerant compressor comprising;

an oil sump;

a crankshaft rotatable about an axis and defining a centrifugal oil pump;

an oil pickup tube extending into said oil sump and secured to said crankshaft coaxial with said axis and rotatable with said crankshaft about said axis as a unit;

an impeller axially mounted on said pickup tube within said oil sump whereby upon rotation of said crankshaft, said impeller causes the production of foam in oil and the creation of a horizontal primary vortex and a vertical secondary vortex wherein said foam is forced towards said axis and the oil forced towards the outside of said oil sump; and a baffle means mounted below said impeller at the bottom of said oil sump and defining a passage for the flow of oil in only said vertical secondary vortex whereby said vertical secondary vortex causes oil near the outside of said oil sump to flow in said defined passage towards said axis to displace said foam, said baffle means is a plurality of generally vertical plates secured to the bottom of said oil sump wherein the oil in said horizontal primary vortex is changed into oil with radial momentum and flows towards said axis in said passage defined by said vertical plates.

2. An oil lubrication and noise suppression system for a refrigerant compressor comprising:

an oil sump;

a crankshaft rotatable about an axis and defining a centrifugal oil pump;

an oil pickup tube extending into said oil sump and secured to said crankshaft coaxial with said axis and rotatable with said crankshaft about said axis as a unit;

an impeller axially mounted on said pickup tube within said oil sump whereby upon rotation of said crankshaft, said impeller causes the production of foam in oil and the creation of a horizontal primary vortex and a vertical secondary vortex wherein said foam is forced towards said axis and the oil forced towards the outside of said oil sump; and a baffle means mounted below said impeller at the bottom of said oil sump and defining a passage for the flow of oil in only said vertical secondary vortex whereby said vertical secondary vortex causes oil near the outside of said oil sump to flow in said defined passage towards said axis to displace said foam, said baffle means is a generally flat horizontal plate spaced from the bottom of said oil sump wherein the oil in said passage defined below said flat horizontal plate only flows towards said axis.

3. An oil lubrication and nosie suppression system for a refrigerant compressor comprising:

an oil sump;

a crankshaft rotatable about an axis and defining a centrifugal oil pump;

an oil pickup tube extending into said oil sump and secured to said crankshaft coaxial with said axis and rotatable with said crankshaft about said axis as a unit;

an impeller axially mounted on said pickup tube within said oil sump whereby upon rotation of said crankshaft, said impeller causes the production of foam in oil and the creation of a horizontal primary vortex and a vertical secondary vortex wherein said foam is forced towards said axis and the oil forced towards the outside of said oil sump; and a baffle means mounted below said impeller at the bottom of said oil sump and defining a passage for the flow of oil in only said vertical secondary vortex whereby said vertical secondary vortex causes oil near the outside of said oil sump to flow in said defined passage towards said axis to displace said foam, said baffle means is a plurality of tube means secured to the bottom of said oil sump and perpendicular to said axis wherein the oil in said passage defined by said tubes only flows towards said axis.

4. An oil lubrication and noise suppression system for a refrigerant compressor comprising:

an oil sump;

a crankshaft rotatable about an axis and defining a centrifugal oil pump;

an oil pickup tube extending into said oil sump and secured to said crankshaft coaxial with said axis and rotatable with said crankshaft about said axis as a unit;

an impeller axially mounted on said pickup tube within said oil sump whereby upon rotation of said crankshaft, said impeller causes the production of foam in oil and the creation of a horizontal primary vortex and a vertical secondary vortex wherein said foam is forced towards said axis and the oil forced towards the outside of said oil sump; and a baffle means mounted below said impeller at the bottom of said oil sump and defining a passage for the flow of oil in only said vertical secondary vortex whereby said vertical secondary vortex causes oil near the outside of said oil sump to flow in said defined passage towards said axis to displace said foam, said baffle means is a plurality of channels formed in the bottom of said oil sump and perpendicular to said axis wherein the oil in said passage defined by said channels only flows towards said axis.

* * * * *